US007868254B2

(12) United States Patent
Matsushita et al.

(10) Patent No.: US 7,868,254 B2
(45) Date of Patent: Jan. 11, 2011

(54) SHIELD FLAT CABLE AND MANUFACTURING METHOD THEREOF

(75) Inventors: Koya Matsushita, Tochigi (JP); Tatsuo Matsuda, Tochigi (JP); Ken Yanagida, Tochigi (JP); Hideo Kobayashi, Tochigi (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 116 days.

(21) Appl. No.: 12/271,067

(22) Filed: Nov. 14, 2008

(65) Prior Publication Data

US 2009/0126972 A1 May 21, 2009

(30) Foreign Application Priority Data

Nov. 15, 2007 (JP) ..... P2007-297316

(51) Int. Cl.
*H01B 7/08* (2006.01)

(52) U.S. Cl. ..... 174/117 FF

(58) Field of Classification Search ..... 174/117 F, 174/117 FF, 78

See application file for complete search history.

(56) References Cited

FOREIGN PATENT DOCUMENTS

| | | |
|---|---|---|
| JP | 3-55206 | 5/1991 |
| JP | 05-242736 | 9/1993 |
| JP | 06-283053 | 10/1994 |
| JP | 11-154424 | 8/1999 |
| JP | 2005-093178 | 4/2005 |

OTHER PUBLICATIONS

Japanese Office Action, w/ English translation thereof, issued in Japanese Patent Application No. JP 2007-297316 dated Jan. 19, 2010.

*Primary Examiner*—Chau N Nguyen
(74) *Attorney, Agent, or Firm*—McDermott Will & Emery LLP

(57) ABSTRACT

A manufacturing method of a flat shield cable has a step of arranging a plurality of flat conductors including a ground line parallel with each other in one plane at a pitch P, a step of forming a flat cable by laminating a first insulating film on the flat conductors from both sides of an arrangement plane of the flat conductors, a step of laminating a shield layer on outside surfaces of the flat cable, and a step of electrically connecting the ground line to the shield layer. The manufacturing method further has a step of cutting the ground line at a portion other than in the conductor exposure portions and folding cutting portions of the ground line to outside the first insulating film before laminating the shield layer, and a step of electrically connecting only the folded ground line among the flat conductors to the shield layer.

1 Claim, 8 Drawing Sheets

SHIELD FLAT CABLE AND MANUFACTURING METHOD THEREOF

FIELD OF THE INVENTION

The present invention relates to a shield flat cable and a manufacturing method thereof which is used in electronic equipment or the like.

DESCRIPTION OF RELATED ART

Wiring members for electric wiring are now desired to enable high-density wiring in a limited space. Such wiring members include flexible circuit boards, flat cables using flat conductors, and electric connectors for connection of such circuit boards and cables. Shield flat cables having a shielding function are used for internal wiring of products requiring an anti-noise measure. For example, wiring of consumer equipment such as audio and video, OA equipment such as printers, scanners and copiers, DVD, CD-ROM, MO equipment, PCs and other electronic equipments.

Flat cables are provided with a plurality of flat conductors arranged parallel with each other in one arrangement plane and insulating films laminated on the flat conductors from both sides of the arrangement plane. In the case of shield flat cables, a shield layer such as a metal foil is provided outside the laminated insulating films. Some of the flat conductors are ground lines. The ground lines are electrically connected to the shield layer.

For example, a shield flat cable described in Japanese laid-open patent publication JP-A-2005-93178 is configured as shown in FIG. 15. A flat cable 110 is constructed by arranging a plurality of flat conductors 112 parallel with each other in one plane at a constant pitch and covering the flat conductor from the top and bottom sides with plastic films (insulating films). Each of plastic films includes an insulative adhesive layer 116 and an insulating layer 114. The flat cable 110 is covered with a shield covering tape 120 having an insulating layer 122 (outermost layer), a metal layer (shield layer) 124 (middle layer) and an insulative adhesive layer 126 (innermost layer). The insulating layer 122 is made of PET or the like, and the metal layer 124 is made of Cu, Al, or the like. The flat conductors 112 located at the right and left ends serve as ground conductors (ground lines) 112*a*. In the shield flat cable 110, as shown in FIG. 16, joining portions 121 are provided over each ground conductor 112*a* at plural locations in the longitudinal direction. In each joining portion 121, the metal layer 124 of the shield covering tape 120 is connected directly to the ground conductor 112*a* without interposition of the insulative adhesive layer 126.

The flat shield cable is manufactured in the following manner. Before lamination of the plastic films, holes are formed through the insulative adhesive layer 116 and the insulating layer 114 with a die or the like at positions right above the ground conductors 112*a*. Alternatively, after lamination of the plastic films and before lamination of the shield covering tape 120, holes are formed through the insulative adhesive layer 116 and the insulating layer 114 with a laser or the like at positions right above the ground conductors 112*a*. Then, the metal layer 124 of the shield covering tape 120 is electrically connected to the ground conductors 112*a* through the holes.

When insulating films are laminated on flat conductors, a plurality of long flat conductors are arranged parallel with each other in one plane and long insulating films are arranged with running on both sides of the flat conductors. The insulating films are laminated on the flat conductors from both sides. Therefore, when holes are formed through the insulating film on one side before the lamination, it is difficult to position the holes with respect to the ground lines correctly at a laminating position of a laminator because of positional errors of the running flat conductors, positional errors of the insulating film, positional errors of the holes in the running insulating film, and other factors. As a result, the holes are sometimes deviated in the width direction. For example, if the pitch of the flat conductors is 0.5 mm and a positional deviation in the width direction is 0.2 mm or larger, a flat conductor that is not designed as a ground line (it is a signal line or a power line) may be connected erroneously to the shield layer and thereby grounded.

When holes are formed with a laser after lamination of the insulating films, holes may not be formed completely because of resin dregs remaining inside the holes. The problem is particularly remarkable in the case where the adhesive layer of the insulating film is of a polyester type. If incomplete holes are formed, a contact failure may occur between a ground line and the shield layer. Thereby, the grounding of the shield layer becomes insufficient. By the insufficient grounding of the shield layer insufficient, a phenomenon such that a noise is prone to be on a signal is caused, and a sufficient shield characteristic can not be obtained. In particular, where a pitch of the flat conductors is small (0.5 mm or less), hole openings are narrow. As a result, a contact failure probably occurs by obstruction of resin dregs.

SUMMARY OF INVENTION

Exemplary embodiments of the present invention provide a shield flat cable and a manufacturing method thereof in which a contact between ground lines and a shield layer is secured and a grounding of the shield layer is reliable.

According to a first aspect of the invention, a shield flat cable is provided with a plurality of flat conductors arranged parallel with each other in one plane at a prescribed pitch, at least one flat conductor being a ground line, an insulating film laminated on the flat conductors from both sides of the plane along which the flat conductors are arranged and a shield layer laminated on the insulating film in a state that both end portions, in a longitudinal direction, of the flat conductors are exposed, wherein the ground line cut at a portion other than in both end portions of the shield flat cable is folded to outside the insulating film and exposed, and wherein only the folded ground line among the flat conductors is electrically connected to the shield layer.

According to a second aspect of the invention, a manufacturing method of a flat shield cable is provided with the steps of arranging a plurality of flat conductors, at least one of which is a ground line, parallel with each other in one plane at a prescribed pitch, forming a flat cable by laminating an insulating film on the flat conductors from both sides of the plane of the flat conductors, exposing the flat conductors at both end portions, in a longitudinal direction, of the flat cable, cutting the ground line at a portion other than in the both end portions of the flat conductors and folding cutting portions of the ground line to outside the insulating film, before laminating the shield layer, laminating a shield layer on the flat cable and electrically connecting only the folded ground line among the flat conductors to the shield layer.

According to a third aspect of the invention, the manufacturing method further comprises steps of forming a window exposing a part of the ground line at a portion in the longitudinal direction other than the both end portions of the flat cable, and having a width greater than or equal to the prescribed pitch and cutting the ground line in the window.

According to a fourth aspect of the invention, the window forming step may provide the window wide enough to expose the flat conductors other than the ground line and the manufacturing method further comprises a step of covering parts, exposed in the window, of the flat conductors other than the ground line with another insulating film different from the insulating film, before laminating the shield layer.

Other features and advantages may be apparent from the following detailed description, the accompanying drawings and claims.

DETAILED DESCRIPTION OF THE PREFERRED EMBODIMENT

An embodiment of a shield flat cable will be hereinafter described with reference to the drawings.

Figure 1:
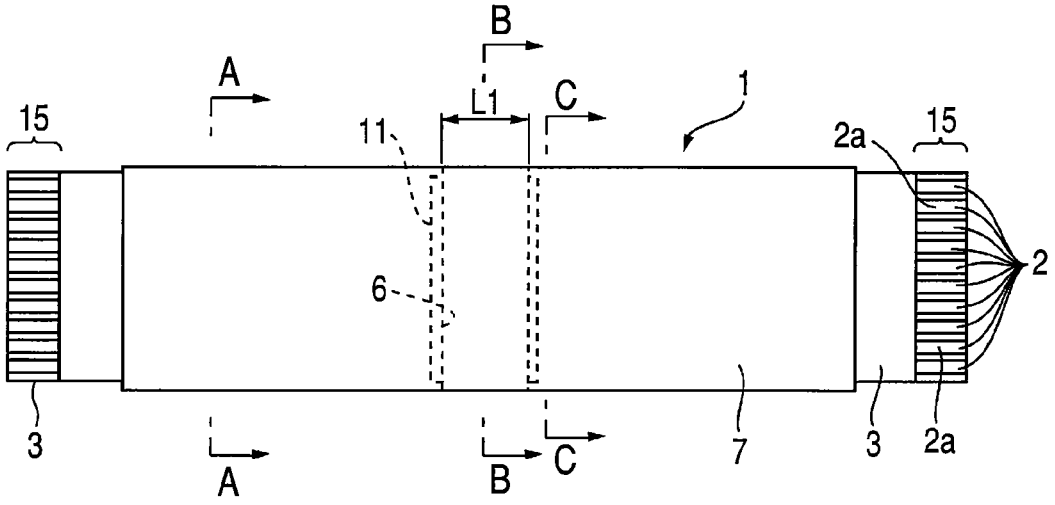
FIG. 1 is a plan view of one surface of a shield flat cable according to the embodiment.
Figure 2:
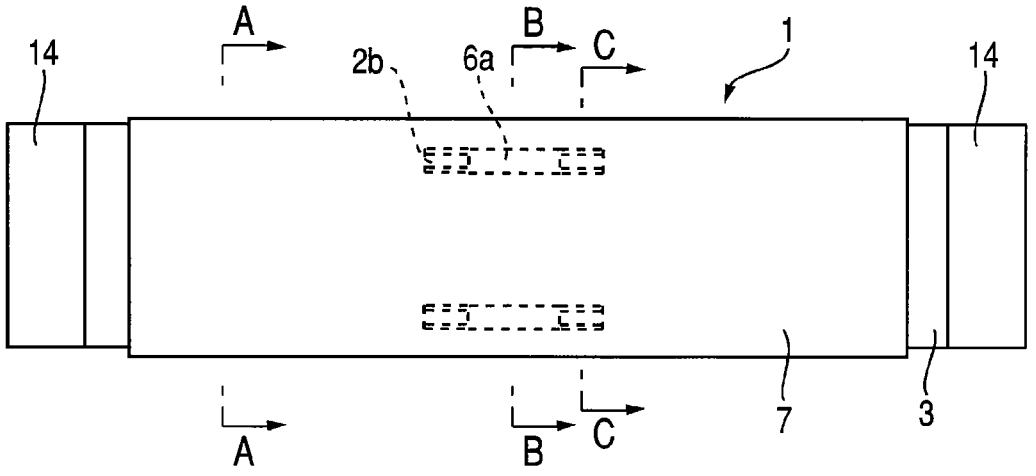
FIG. 2 is a plan view of the other surface of the shield flat cable according to the embodiment.
Figure 3:
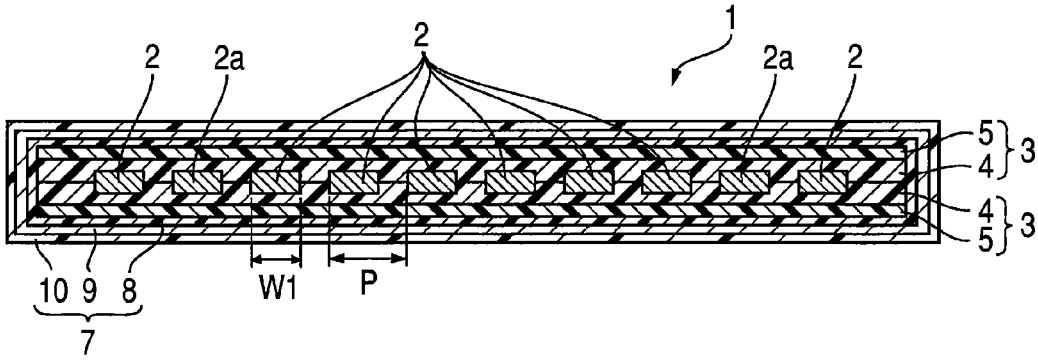
FIG. 3 is a sectional view on arrow A-A in FIGS. 1 and 2.
Figure 4:
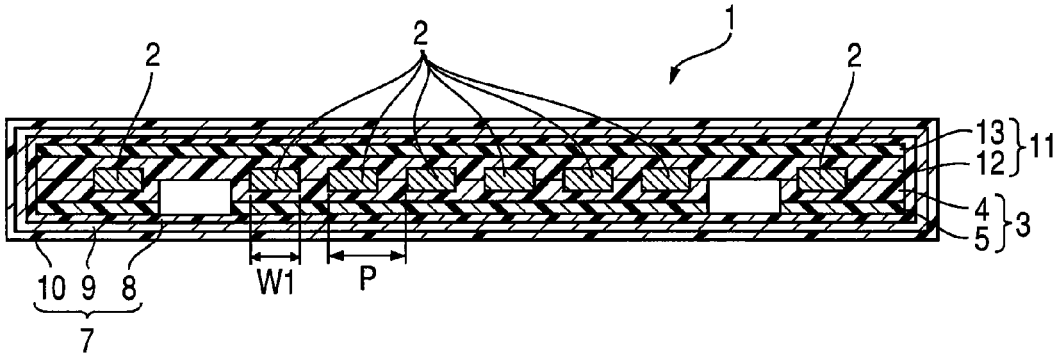
FIG. 4 is a sectional view on arrow B-B in FIGS. 1 and 2.
Figure 5:
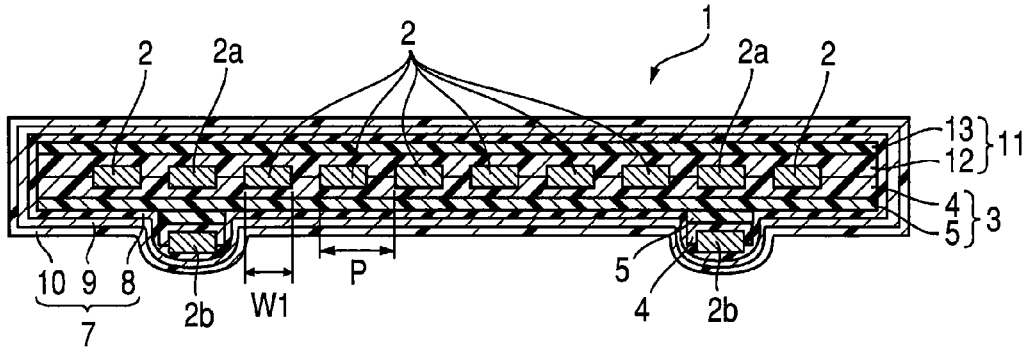
FIG. 5 is a sectional view on arrow C-C in FIGS. 1 and 2.

FIG. 1 is a plan view of one surface of the shield flat cable according to the embodiment. FIG. 2 is a plan view of the other surface of the shield flat cable of FIG. 1. FIG. 3 is a sectional view on arrow A-A in FIGS. 1 and 2. FIG. 4 is a sectional view on arrow B-B in FIGS. 1 and 2. FIG. 5 is a sectional view on arrow C-C in FIGS. 1 and 2. FIGS. 3 to 5 are drawn with the one surface of FIG. 1 as the top surface.

Figure 11:
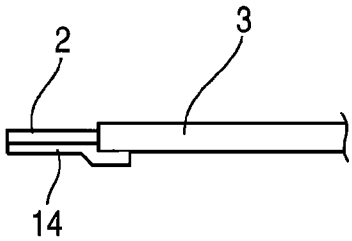
FIG. 11 is a partial side view of FIG. 8.

As shown in FIGS. 1 to 5, a shield flat cable 1 is provided with a plurality (in this embodiment, 10 strips) of flat conductors 2. The flat conductors 2 are arranged parallel with each other in one plane at a prescribed pitch. First insulating films 3 each including a first insulator are laminated on both surfaces of the flat conductors 2. A shield film 7 having a shield layer 9 is laminated on outside surfaces of the first insulating films 3. Both end portions, in the longitudinal direction, of the shield flat cable 1 are conductor exposure portions 15. All flat conductors 2 are exposed on one surface of the conductor exposure portions 15 (i.e., a surface shown in FIG. 1). The first insulating film 3 is laminated on the flat conductors 2 on the other surface of the conductor exposure portions 15 (i.e., a surface shown in FIG. 2). Each conductor exposure portion 15 thus serves as a connection terminal capable of being connected to elastic contact pieces or the like of an electric connector. As shown in FIGS. 2 and 11, a supporting tape 14 made of an insulative resin such as polyester is laminated to the other surface, where the flat conductors 2 are not exposed, of each conductor exposure portion 15. The supporting tapes 14 support the flat conductors 2 and prevent the deformation of the flat conductors 2.

The first insulating film 3 on the one side of the shield flat cable 1 is provided with a window 6 at a portion, in the longitudinal direction, of the shield flat cable 1 except in the conductor exposure portions 15. Whereas the first insulating films 3 are laminated on the two respective surfaces of the flat conductors 2 except in the conductor exposure portions 15 and the window 6, the first insulating film 3 is not laminated on the one surface of the flat conductors 2 in the window 6. Among 10 strips of the flat conductors 2, the second flat conductors 2 as counted from both ends in the width (i.e., arrangement) direction are ground lines 2*a*. The flat conductors 2 other than the ground lines 2*a* are signal lines and power lines or unused lines. In the window 6, a second insulating film 11 including a second insulator is laminated to the flat conductors 2.

Each flat conductor 2 includes a tin plated layer formed on a copper base member having a rectangular cross shape. In the embodiment, the tin plated layer is formed so as to completely cover the copper base member. The copper base member is made of copper or a copper alloy. In the conductor exposure portions 15 to serve as connection terminals, needle-like crystals (whiskers) may form on the surface of the flat conductors 2 by receiving compressive stress for physical contact. Then, to prevent formation of the whiskers, the flat conductors 2 are plated with gold. The gold plating prevents formation of the whiskers and thereby prevents short-circuiting between the flat conductors 2 arranged at a small pitch. Reliability of the electrical connection between the flat conductors 2 and an electric connector is thus increased.

In the embodiment, a thickness, a width W1, and a pitch P of the 10 strips of the flat conductors 2 are 0.035 mm, 0.3 mm, and 0.5 mm, respectively.

Each first insulating film 3 includes an insulating resin layer 5 (first insulator) and an insulative adhesive layer 4. For example, the insulating resin layer 5 is made of a resin such as polyester, polyimide, or PPS. The insulative adhesive layer 4 is made of a polyester adhesive or a flame retardant PVC. The two first insulating films 3 are laminated on the flat conductors 2 with the insulative adhesive layers 4 opposed to each other. The flat conductors 2 are thereby electrically insulated from each other.

The shield film 7 includes a conductive adhesive layer 8, a shield layer 9, and a resin layer 10. For example, the conductive adhesive layer 8 is made of an adhesive containing a conductive filler, the shield layer 9 is made of aluminum or copper, and the resin layer 10 is made of polyester such as PET. The conductive adhesive layer 8 establishes excellent electric connection between the shield layer 9 and the ground lines 2*a*. The shield layer 9 generates a shield effect to the shield flat cable 1. The resin layer 10 prevents peeling and corrosion of the shield layer 9 and thereby keeps the shield flat cable 1 reliable.

As shown in FIGS. 3 to 5, the single shield film 7 is wound around and laminated on the shield flat cable 1 so as to cover an entire circumference of the shield flat cable 1. Alternatively, as well as the first insulating films 3, two shield films may be opposed to each other and laminated on the shield flat cable 1.

As shown in FIG. 3, the first insulating films 3 are laminated on all the flat conductors 2 in most of the longitudinal length of the shield flat cable 1. As shown in FIGS. 1 to 4, the window 6 is provided on one surface of the first insulating film 3 at a portion, in the longitudinal direction, of the shield flat cable 1. The first insulating film 3 is not laminated in the window 6. The width of the window 6 is at least greater than or equal to the pitch P of the flat conductors 2. In this embodiment, the width of the window 6 is equal to the entire width over which the first insulating films 3 are laminated on the parallel-arranged flat conductors 2.

Each ground line 2*a* is cut in the window 6 together with the other first insulating film 3, and cutting portions of the ground line 2*a* are folded in end portion of the window 6 toward outside portions of the other first insulating film 3. As shown in FIGS. 2 and 5, folded portions 2*b* of each ground line 2*a* are laminated to the conductive adhesive layer 8 of the shield film 7. The ground line 2*a* is electrically connected to the shield layer 9.

As shown in FIGS. 1 and 4, a second insulating film 11 is an additional insulating film separated from the first insulating films 3. In the window 6, the second insulating film 11 is laminated on the flat conductors 2 and the first insulating film 3 so as to cover the window 6. When each ground line 2*a* is folded at positions inward from the ends, in the longitudinal direction, of the window 6, an unfolded portions of the cutting portions of each ground line 2*a* are also covered with the second insulating film 11. Therefore, in the window 6, one surface of the flat conductors 2 is covered with the second insulating film 11 and thereby insulated electrically. The other surface of the flat conductors 2 is covered with the first insulating film 3 and thereby insulated electrically.

The second insulating film 11 may be made of similar materials to the first insulating films 3. For example, the second insulating film 11 includes an insulating resin layer 13 (second insulator) and an insulative adhesive layer 12. The insulating resin layer 13 is made of a resin such as polyester, polyimide, PPS, and the insulative adhesive layer 12 is made of a polyester adhesive or a flame retardant PVC.

The second insulator is not limited to a film form as long as the second insulator can insulate the flat conductors 2 (signal lines and power lines) exposed through the window 6. For example, the second insulator may be made of an insulating material such as an ink or a coating material.

Where the insulating resin layers 5 of the first insulating films 3 and the insulating resin layers 13 of the second insulating film 11 are made of polyimide, the accuracy of the film shape is high. Hence the window 6 etc. can be formed accurately.

As for the material and the thickness of the second insulating film 11, examples of the second insulating film 11 are a polyimide tape having thickness of 0.035 mm, a polyester tape having thickness of 0.022 mm, a PPS tape having thickness of 0.020 mm, and a polyimide tape having thickness of 0.025 mm. The insulative adhesive layer 12 of the second insulating film 11 may also be made of an acrylic resin.

Next, a manufacturing method of the above-mentioned shield flat cable 1 will be described step by step.

First, a plurality (in this embodiment, 10 strips) of flat conductors 2 (including ground lines 2*a*) having a rectangular cross shape are prepared. The flat conductors 2 include a tin plated layer formed on the surfaces of a copper base member.

Figure 6:
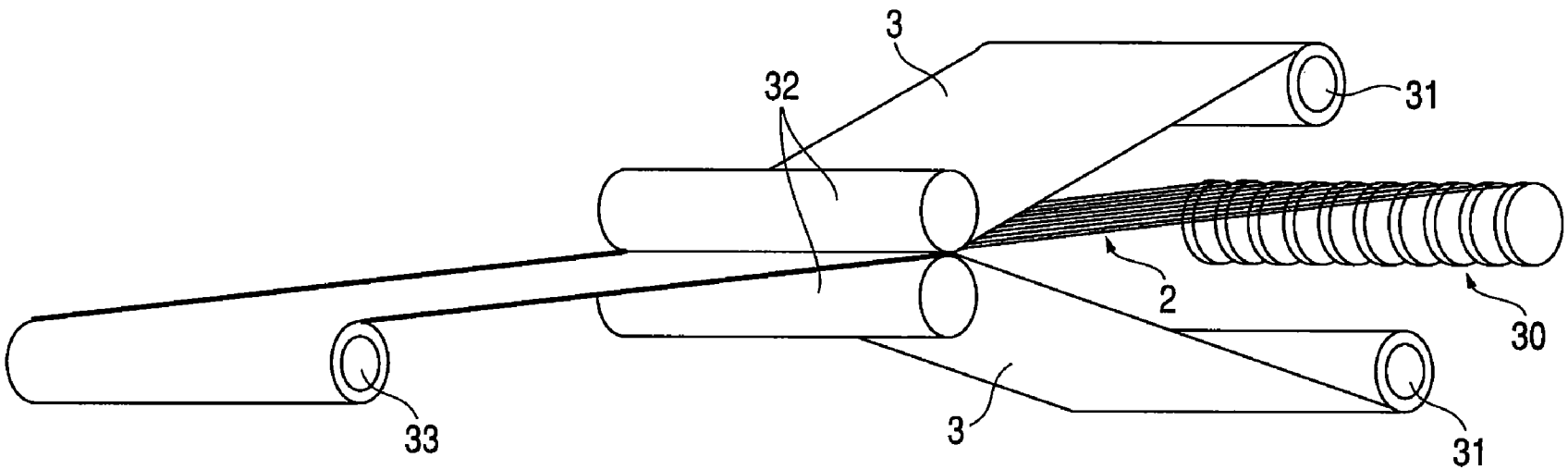
FIG. 6 is a schematic perspective view showing an insulating film laminating step of a manufacturing method according to the embodiment.

Then, as shown in FIG. 6, the long flat conductors are wound on a plurality of reels 30. The flat conductors 2 are pulled out from the reels 30 and arranged parallel with each other in one plane at a prescribed pitch (arranging step). Then, long first insulating films 3 are pulled out from respective reels 31 so as to run over and under the flat conductors 2. The flat conductors 2 and the first insulating films 3 are run between heater rollers 32 and taken up on a take-up roller 33 (insulating film laminating step).

In the insulating film laminating step, the first insulating films 3 are oriented so that an insulative adhesive layers 4 of the first insulating films 3 are opposed to each other. That is, as the flat conductors 2 and the first insulating films 3 pass between the heater rollers 32, the insulative adhesive layers 4 of the first insulating films 3 are melted and the first insulating films 3 (actually the insulative adhesive layers 4) are laminated, from the front side and the back side, on the flat conductors 2. A long continuous flat cable is formed by arranging the flat conductors 2 parallel with each other in one plane and covering the flat conductors 2 with the insulating resins (insulating resin layers 5 and insulative adhesive layers 4).

Figure 7:
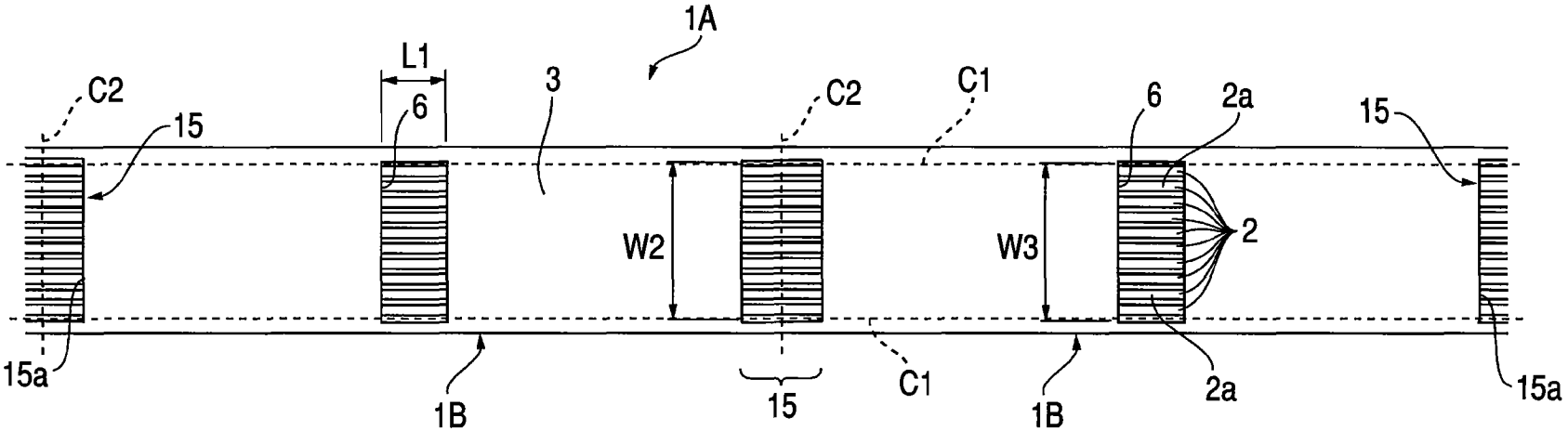
FIG. 7 is a plan view of a long flat cable as produced by the insulating film laminating step of the manufacturing method according to the embodiment.

FIG. 7 shows a part of a long flat cable 1A. To form the conductor exposure portions 15 and the window 6 shown in FIG. 1, conductor exposure windows 15*a* and a window 6 are formed at certain portions in the longitudinal direction on the one side of the first insulating film 3 of the long flat cable 1A. The conductor exposure windows 15*a* are formed at portions of the ends, in the longitudinal direction, of each shield flat cable 1. The window 6 is formed at a portion other than in the conductor exposure windows 15*a*, for example, an approximately center portion, in the longitudinal direction, of each shield flat cable 1. A width W2 of the conductor exposure windows 15*a* is set greater than a parallel arrangement width of the flat conductors 2 so that all the flat conductors 2 are exposed. A width W3 of the window 6 is set greater than or equal to the pitch P at the portions corresponding to the ground lines 2*a* so that the first insulating film 3 is not laminated on at least the ground lines 2*a*. In the embodiment, W2 and W3 are set identical. That is, in the embodiment, the window 6 is formed in such a shape that the first insulating film 3 is not laminated on any the flat conductors 2. Alternatively, the windows 6 may be formed to have a width greater than or equal to the pitch P at such portions as to expose only the ground lines 2*a*.

When the first insulating film 3 is laminated on the flat conductors 2, a positional relationship between the flat conductors 2 and the first insulating film 3 may deviate in the width direction. If the width W3 of the window 6 is smaller than the deviation, it may occur an event that the ground lines 2*a* are covered with the first insulating film 3 and are not exposed. Therefore, the width W3 of the window 6 should be set greater than the deviation. Usually, the laminator shown in FIG. 6 is designed in accuracy so that the maximum deviation is smaller than the pitch P of the flat conductors 2 upon laminating the first insulating film 3 on the flat conductors 2. In the embodiment, the width W3 of the window 6 is set greater than or equal to the pitch P. Therefore, even if the positional relationship between the flat conductors 2 and the first insulating film 3 is somewhat deviated in the width direction upon laminating the first insulating film 3 on the flat conductors 2, it is prevented that the first insulating film 3 is laminated on a ground line 2*a* at the window 6. As a result, it is possible to electrically connect reliably the ground lines 2*a* to the shield layer 9 in a later step.

Further, to allow the first insulating film 3 to get the insulation effect sufficiently, it is preferable that a length L1 of the window 6 (see FIGS. 1 and 7) is shorter than or equal to a half length of the shield flat cable 1. In addition, a plurality of windows 6 may be provided in the longitudinal direction of the shield flat cable 1.

Figure 8:
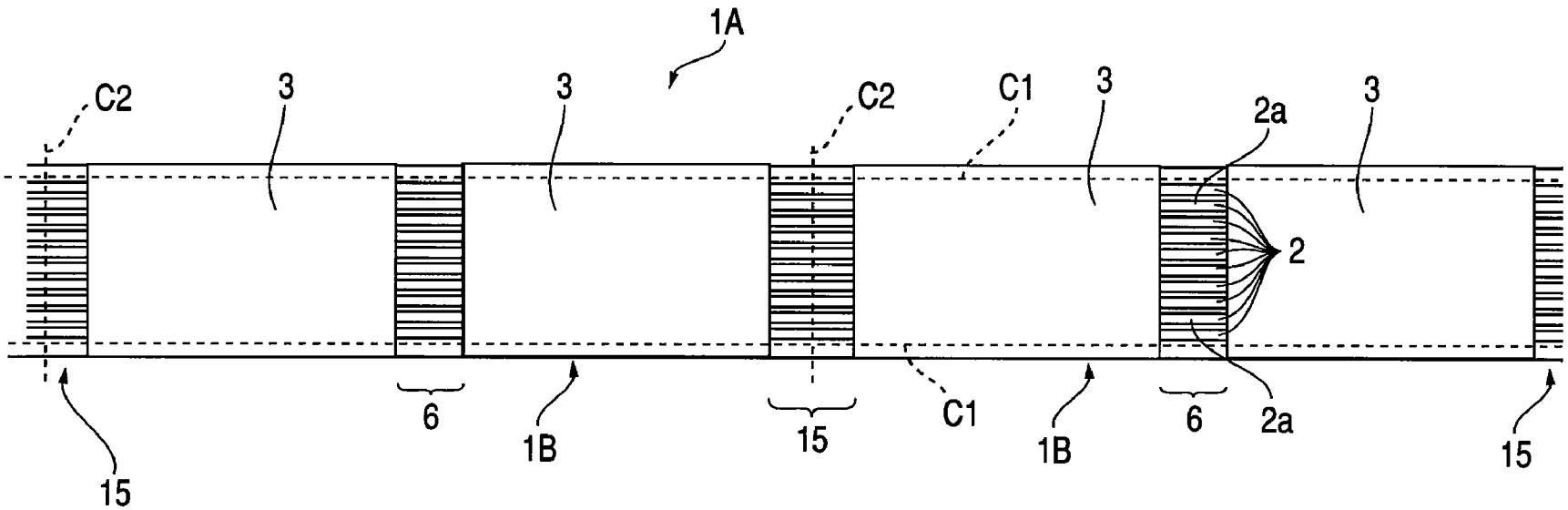
FIG. 8 is a plan view of a long flat cable as produced by another insulating film laminating step of the manufacturing method according to the embodiment.

As described above, in the insulating film laminating step, the windows 6 and the conductor exposure windows 15*a* are formed by laminating the first insulating film 3 having the windows 6 and the conductor exposure windows 15*a* opened in advance on the flat conductors 2 continuously in the longitudinal direction. Alternatively, as shown in FIG. 8, windows 6 and conductor exposure windows 15*a* may be formed by laminating short first insulating films 3 on the flat conductors 2 intermittently in the longitudinal direction.

After the insulating film laminating step, the long flat cable 1A is cut along broken lines C1 (see FIGS. 7 and 8) to remove unnecessary end portions (called ears) in the width direction from the first insulating films 3. As a result, connecting portions of the first insulating film 3 which are adjacent both ends, in the width direction, of each window 6 and each conductor exposure window 15*a* are removed.

When portions of the flat conductors 2 in the conductor exposure portions 15 are plated with gold or the like, a plating step is performed on the long flat cable 1A.

Figure 9:
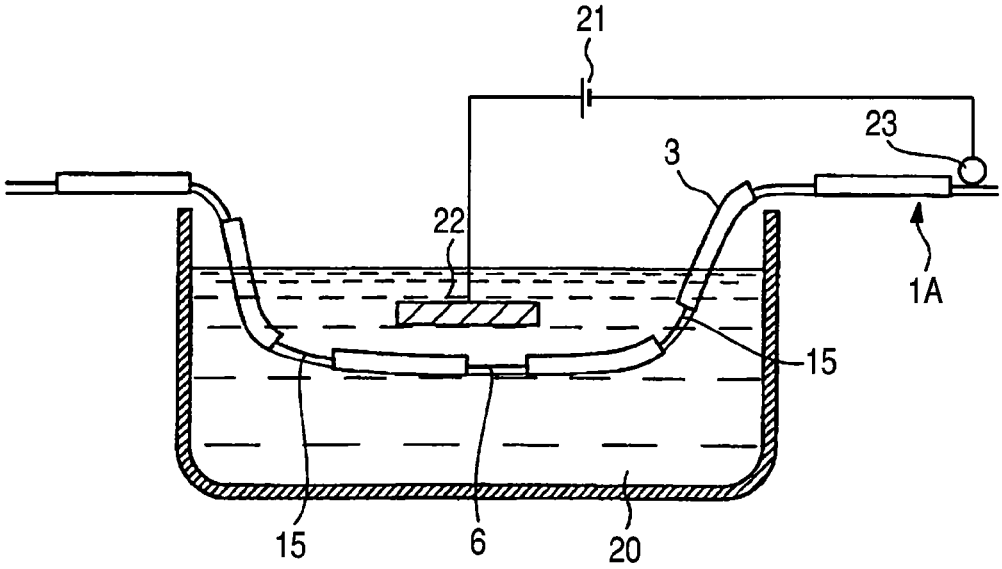
FIG. 9 is a schematic diagram showing a plating step of the manufacturing method according to the embodiment.

In the plating step, as shown in FIG. 9, the long flat cable 1A is fed intermittently into a plating liquid tank 20 and soaked in a plating liquid. Exposed portions of the flat conductors 2 in the conductor exposure portions 15 of the long flat cable 1A are subjected to electroplating. To deposit a plating metal on the exposed portions of the flat conductors 2, a conductive member 23 is crossed on all the exposed portions of the flat conductors 2 in at least one conductor exposure portion 15. The conductive member 23 is electrically connected to the exposed portions of the flat conductors 2. With the long flat cable 1A soaked in the plating liquid, the conductive member 23 is connected to a negative potential side of a plating power source 21 with an electric clip or the like outside the plating liquid. A plating metal member 22 soaked in the plating liquid is connected to a positive potential side of the plating power source 21.

Instead of feeding the long flat cable 1A continuously into the plating liquid tank 20 and soaking the long flat cable 1A in the plating liquid (continuous plating), the long flat cable 1A may be divided into parts having a length capable to be placed in the plating liquid tank 20. Thus, divisional cables are soaked in the plating liquid.

Plating on the conductor exposure portions 15 (terminals) is performed for the purposes of preventing whiskers from occurring in the terminals and increasing a reliability of electric connection between the terminals and an electric connector. Gold plating is preferable for the purposes. However, if gold plating is performed on a tin plated layer, electric corrosion may occur due to contact of the different metals to disable long-term use. Therefore, it is preferable to perform gold plating after plating nickel as a primer metal.

In the plating step, the plating may be performed on not only the conductor exposure portions 15 but also the windows 6. The step is efficient because the long flat cable 1A can be fed continuously into the plating liquid tank 20 and soaked in the plating liquid. Alternatively, plating may be performed continuously by masking the windows 6 temporarily with tapes or the like.

The long flat cable 1A (actually the conductor exposure portions 15) processed as above is cut along broken lines C2 (see FIGS. 7 and 8). A flat cable 1B having a prescribed length is obtained as shown in FIG. 10 (cutting step).

Figure 10:
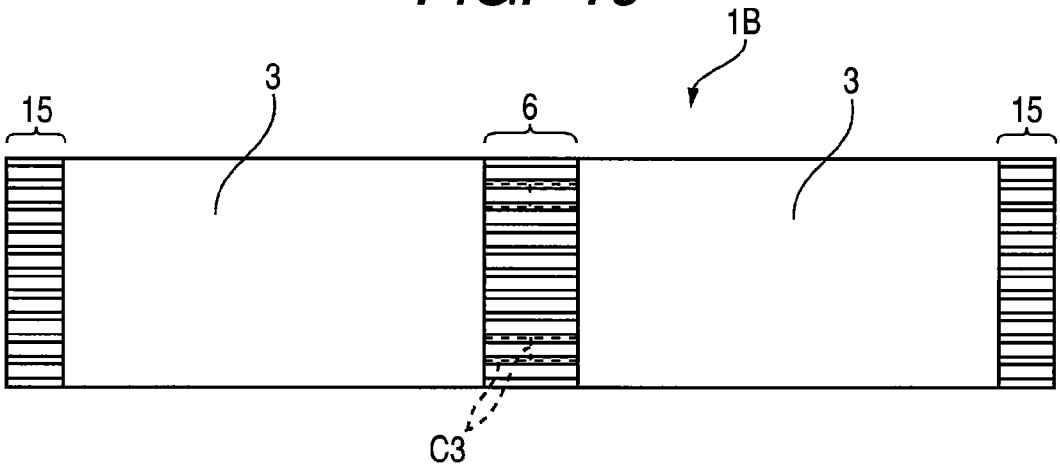
FIG. 10 is a plan view showing a flat cable as produced by the cutting step of the manufacturing method according to the embodiment.

Then, as shown in FIG. 11, a supporting tape 14 is laminated to one surface of each conductor exposure portion 15 of the flat cable 1B, which is the cut flat cable 1A in FIG. 10, so as to support the flat conductors 2. Alternatively, the first insulating film 3 may be left in each conductor exposure portion 15. The supporting tape 14 may be laminated to the first insulating film 3.

Figure 12:
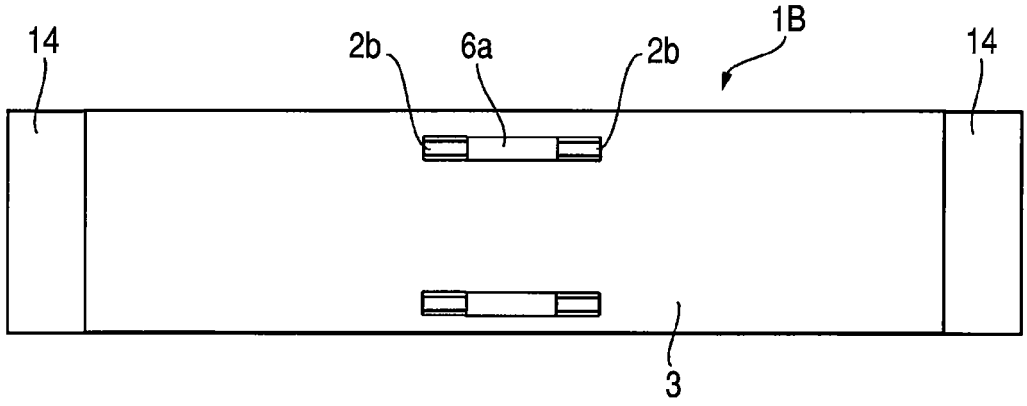
FIG. 12 is a plan view showing a flat cable as produced by a folding step of the manufacturing method according to the embodiment.

Then, in the window 6, the ground lines 2*a* and the first insulating film 3 around the ground lines 2*a* are cut along broken lines C3 (see FIG. 10). As shown in FIG. 12, cutting portions of each ground line 2*a* in the window 6 are folded to outside the first insulating film 3 located on the opposite side to the window 6 (i.e., to outside the other first insulating film 3) together with the associated cutting portions of the first insulating film 3. The cutting portions of the ground line 2*a* and the first insulating film 3 form folded portions 2*b* of the ground line 2*a* (folding step). As a result, spaces 6*a* are formed in the portions occupied by the folded portions 2*b* before the folding. The spaces 6*a* are open on both sides of the flat cable 1B. FIG. 12 is a plan view as viewed from the opposite side to the side of viewing of FIG. 1.

Figure 13:
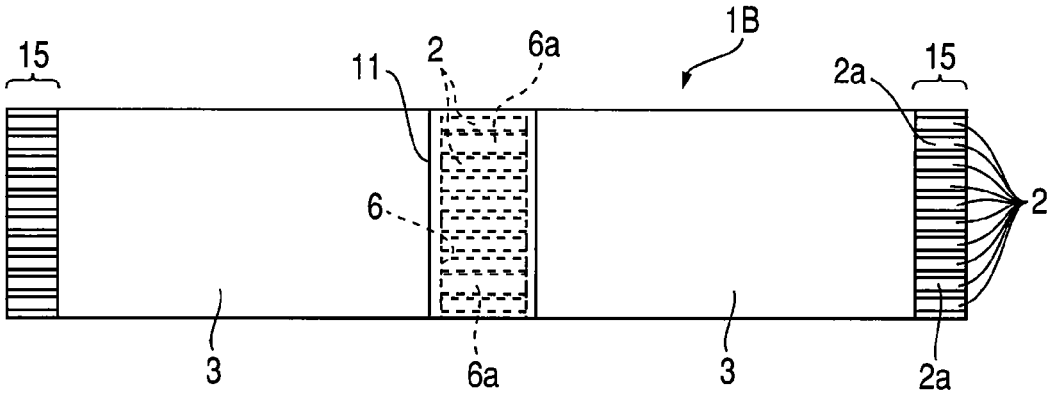
FIG. 13 is a plan view showing one surface of a flat cable as produced by an additional insulating step of the manufacturing method according to the embodiment.
Figure 14:
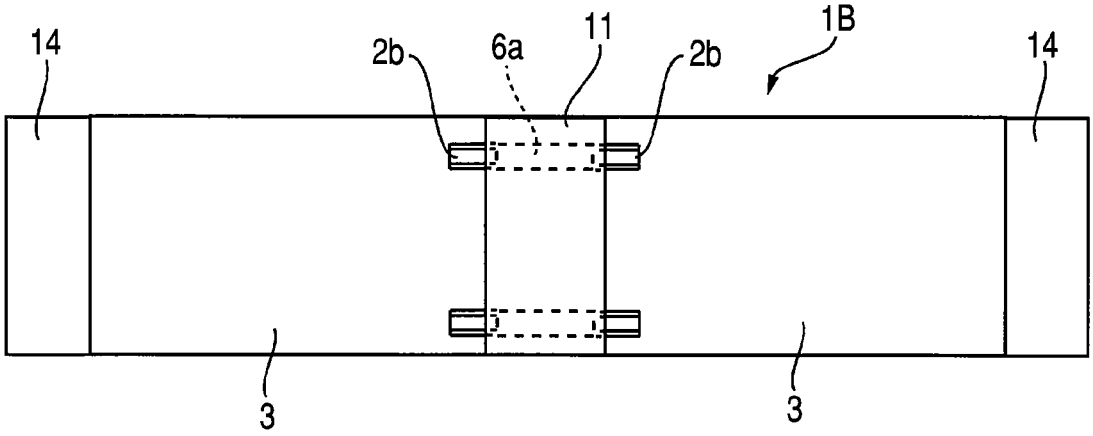
FIG. 14 is a plan view showing the other surface of a flat cable as produced by another additional insulating step of the manufacturing method according to the embodiment.
Figure 15:
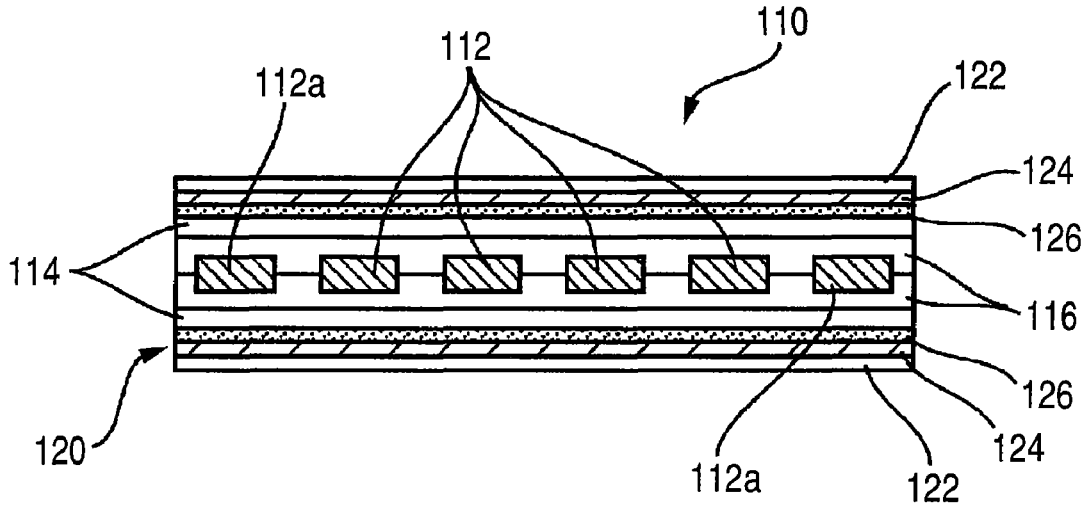
FIG. 15 Prior Art
FIG. 15 is a sectional view of a conventional shield flat cable.
Figure 16:
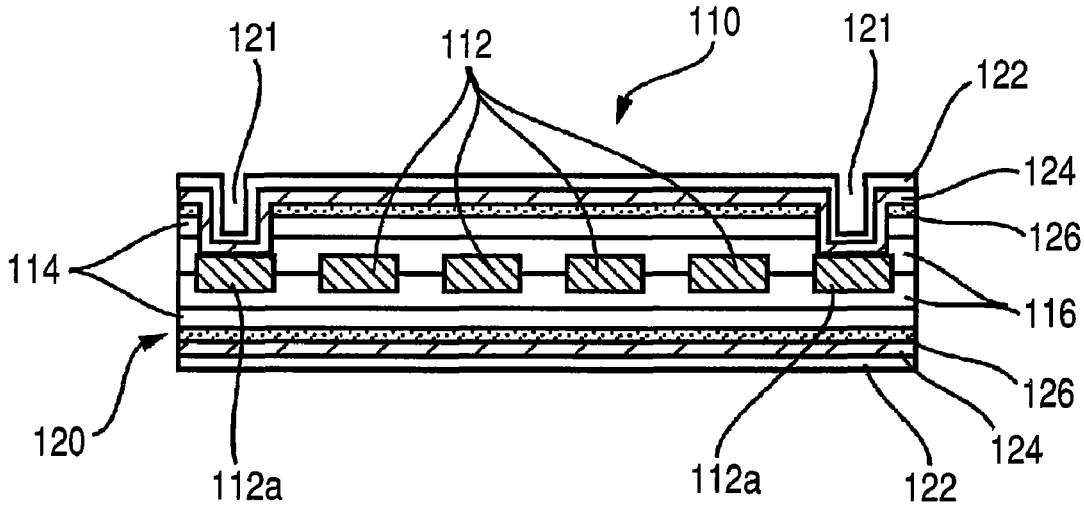
FIG. 16 Prior Art
FIG. 16 is a sectional view, taken along another line, of the shield flat cable of FIG. 15.

After the folding step, as shown in FIG. 13, a second insulating film 11 (additional insulating film) is laminated to the entire window 6 so as to cover the exposed portions of the flat conductors 2 other than the ground lines 2*a* (additional insulating step). The second insulating film 11 is laminated by thermal laminating. Unlike the above-described insulating film laminating step, the step of laminating the second insulating film 11 is executed for each short flat cable 1B. Therefore, for example, the second insulating film 11 can be laminated in a state that the flat cable 1B is placed on a stage or the like. As a result, the second insulating film 11 or the flat cable 1B does not deviate when the second insulating film 11 is laminated to the flat cable 1B. The second insulating film 11 can be laminated to the flat cable 1B at a correct position.

In the above example, the second insulating film 11 is laminated to only the one surface in which the flat conductors 2 other than the ground lines 2*a* are exposed through the window 6. Alternatively, another second insulating film 11 may be laminated to the other surface (i.e., a surface opposite to the window 6) which has the folded portions 2*b*. At this time, a length of the second insulating film 11 is set so as not to fully cover the folded portions 2*b*, but is set so as to just cover the spaces 6*a* (or a little greater). Instead of laminating the two second insulating films 11 to the respective surfaces of the flat cable 1B, a single second insulating film 11 may be wound around the flat cable 1B.

After the additional insulating step, as shown in FIGS. 1 to 5, a shield film 7 is laminated on the flat cable 1B excluding the conductor exposure portions 15 and the neighborhoods (shield layer laminating step). The single shield film 7 may be wound around the flat cable 1B, and two shield films 7 may be laminated on the respective surfaces of the flat cable 1B. As a result of the lamination of the shield film 7, the folded portions 2*b* of the ground lines 2*a* folded and exposed to outside the first insulating film 3 are electrically connected to the shield layer 9 of the shield film 7 (connecting step). The flat conductors 2 other than the ground lines 2*a* are covered with the first insulating film 3 and the second insulating film 11 except in the conductor exposure portions 15 which are located at both ends of the flat cable 1B. Hence, the flat conductors 2 other than the ground lines 2*a* are insulated from the shield layer 9.

In the embodiment, since the shield film 7 includes the conductive adhesive layer 8, the conductive adhesive layer 8 is laminated to the folded portions 2*b* in the shield layer laminating step. Hence, the connecting step is executed simultaneously with the shield layer laminating step. When the conductive adhesive layer 8 is not used, it is necessary to connect the shield layer 9 to the folded portions 2*b* by welding or the like after the shield layer laminating step.

As described above, in the shield flat cable 1 and the manufacturing method thereof according to the embodiment of the invention, exposed portions of each ground line 2*a* obtained by cutting the ground line 2*a* and folding cutting portions of the ground line 2*a* to outside the first insulating film 3 are electrically connected to the shield layer 9. Therefore, even if a positional deviation occurs in the width direction upon laminating the first insulating films 3 on the flat conductors 2, the shield layer 9 can be reliably connected to the folded portions 2*b* formed by folding the cutting portions of each ground line 2*a*. The shield layer 9 can be grounded reliably. The width W3 of the window 6 is set greater than or equal to the pitch P of the flat conductors 2 so that the first insulating film 3 is not laminated to at least the ground lines 2*a*. Therefore, even if the first insulating film 3 is deviated, one surface of each ground line 2*a* is exposed in the window 6 and portions of each ground line 2*a* can be exposed reliably by cutting the ground line 2*a* in the window 6 and folding the cutting portions of the ground line 2*a* to outside the first insulating film 3.

In the above embodiment, although the window 6 is formed only in one surface of the shield flat cable 1, windows 6 may be formed in the two respective surfaces of the shield flat cable 1. When the windows 6 are formed in the two respective surfaces, to prevent the flat conductors 2 other than the ground lines 2*a* from being electrically connected to the shield film 7, second insulating films 11 are laminated to the two respective surfaces after folding and exposing the folded portions 2*b* of the ground lines 2 on one side of the first insulating film 3. In addition, a plurality of windows 6 may be formed in the one surface of the shield flat cable 1.

The folded portions 2*b* may be provided on either surface of the shield flat cable 1. Further, the folded portions 2*b* may be provided on both surfaces of the shield flat cable 1. When the folded portions 2*b* are provided only on one surface of the shield flat cable 1, the shield layer 9 may be provided only on the side where the folded portions 2*b* exist.

One surface having the conductor exposure portions 15 can be changed as appropriate. The conductor exposure portions 15 may be provided on either the surface having the folded portions 2*b* or the opposite surface. Furthermore, the conductor exposure portions 15 may be provided at the ends of the different surfaces of the shield flat cable 1. In addition, the supporting tapes 14 provided on the back sides of the conductor exposure portions 15 in the embodiment may not be necessarily provided.

In the above embodiment, although the width W3 of the window 6 is set such that the first insulating film 3 is laminated to none of the flat conductors 2, it may be set somewhat greater than the pitch P of the flat conductors 6 so that only the ground lines 2*a* are exposed. In this case, the second insulating film 11 is not necessarily provided because the flat conductors 2 other than the ground lines 2*a* are not exposed.

Besides, the window 6 may not be provided. In this case, for example, each ground line 2*a* is cut and folded together with the first insulating films 3 at a portion other than in the conductor exposure portions 15. Then, the folded portions of the first insulating film 3 are removed from the folded portions 2*b* of the ground line 2*a*. The resulting folded portions 2*b* are connected to the shield layer 9. Even in this embodiment, the ground lines 2*a* can be connected to the shield layer 9 reliably irrespective of positional deviations that may occur upon laminating the first insulating films 3 on the flat conductors 2.

In the above embodiment, although the cutting step for cutting the long flat cable 1A into individual flat cables 1B is executed before the folding step, it may be executed after the folding step or the shield layer laminating step.

A shield flat cable is known in which ground lines are arranged and outside ground lines are folded in conductor exposure portions and connected to a shield layer. In this case, even if plating is performed continuously as in the above embodiment, ground line portions arranged inside cannot be plated. Therefore, plating should be performed after cutting into short cables and folding of ground lines. In contrast, in the shield flat cable 1 according to the embodiment, plating can be performed efficiently by continuous plating.

What is claimed is:

1. A manufacturing method of a flat shield cable, the method comprising steps of:

arranging a plurality of flat conductors, at least one of which is a ground line, parallel with each other in one plane at a prescribed pitch;

forming a flat cable by laminating an insulating film on the flat conductors from both sides of the plane of the flat conductors;

exposing the flat conductors at both end portions, in a longitudinal direction, of the flat cable;

forming a window exposing a part of the ground line at a portion in the longitudinal direction other than the both end portions of the flat cable, and having a width greater than or equal to the prescribed pitch;

cutting the ground line in the window and folding cutting portions of the ground line to outside the insulating film, before laminating a shield layer;

covering parts, exposed in the window, of the flat conductors other than the ground line with another insulating film different from the insulating film, before laminating the shield layer;

laminating the shield layer on the flat cable; and electrically connecting only the folded ground line among the flat conductors to the shield layer, wherein the window forming step provides the window wide enough to expose the flat conductors other than the ground line.

* * * * *